US007314322B2

(12) United States Patent
Hamashima et al.

(10) Patent No.: US 7,314,322 B2
(45) Date of Patent: Jan. 1, 2008

(54) PRINTING SYSTEM THAT CORRECTS IMAGE DATA BASED ON ENVIRONMENTAL HISTORY DATA

(75) Inventors: Mitsuhiro Hamashima, Shinjuku-Ku (JP); Koichi Shirai, Shinjuku-Ku (JP); Yasuko Deushi, Shinjuku-Ku (JP); Junichi Hiroi, Shinjuku-Ku (JP); Kenichi Hagiwara, Shinjuku-Ku (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 10/514,825

(22) PCT Filed: May 20, 2003

(86) PCT No.: PCT/JP03/06284

§ 371 (c)(1),
(2), (4) Date: Nov. 17, 2004

(87) PCT Pub. No.: WO03/097367

PCT Pub. Date: Nov. 27, 2003

(65) Prior Publication Data

US 2005/0204946 A1 Sep. 22, 2005

(30) Foreign Application Priority Data

May 22, 2002 (JP) ..... 2002-147931

(51) Int. Cl.
*B41J 2/315* (2006.01)
*B41J 2/36* (2006.01)

(52) U.S. Cl. ..... 400/120.01; 347/194

(58) Field of Classification Search ..... 400/120.01; 347/194, 184, 196, 172; 358/1.9, 1.15; 101/484
See application file for complete search history.

(56) References Cited

U.S. PATENT DOCUMENTS

| | | | | |
|---|---|---|---|---|
| 5,006,866 | A | 4/1991 | Someya | 347/196 |
| 5,006,868 | A * | 4/1991 | Someya | 347/196 |
| 5,039,601 | A * | 8/1991 | Ohya et al. | 430/569 |
| 5,086,306 | A * | 2/1992 | Sasaki | 347/184 |
| 5,220,350 | A * | 6/1993 | Fujii | 347/194 |
| 5,539,443 | A * | 7/1996 | Mushika et al. | 347/194 |
| 5,644,351 | A * | 7/1997 | Matsumoto et al. | 347/194 |

(Continued)

FOREIGN PATENT DOCUMENTS

| | | |
|---|---|---|
| JP | 64-051959 | 2/1989 |

(Continued)

*Primary Examiner*—Daniel J. Colilla
(74) *Attorney, Agent, or Firm*—Oliff & Berridge, PLC

(57) ABSTRACT

A printing system according to the present invention includes a media terminal box which may be installed on a street. In the box, there are disposed a measuring device that measures the temperature or humidity in the box, a device such as a CPU, and a storage device. The storage device stores correction data including a correction value based on a combination of the temperature and humidity, and history data relating to the temperature and humidity measured by the measuring device. The control device corrects a color tone of image data which is read out from the storage device based on the temperature/humidity history data and the correction data so as to generate corrected image data. The corrected image data is sent to a printer, and then the printer is operated based on the corrected image data.

11 Claims, 4 Drawing Sheets

U.S. PATENT DOCUMENTS

| | | | | |
|---|---|---|---|---|
| 5,659,328 | A * | 8/1997 | Todokoro et al. | 345/74.1 |
| 6,230,622 | B1 * | 5/2001 | Dilling | 101/484 |
| 6,829,058 | B1 * | 12/2004 | Kumada | 358/1.15 |
| 2002/0029714 | A1 * | 3/2002 | Hale et al. | 101/484 |
| 2002/0107613 | A1 * | 8/2002 | Hopkins | 700/269 |
| 2002/0136582 | A1 | 9/2002 | Verdyck | 400/120.01 |
| 2002/0191066 | A1 | 12/2002 | Bouchard et al. | 347/172 |
| 2003/0043251 | A1 | 3/2003 | Saquib et al. | 347/194 |

FOREIGN PATENT DOCUMENTS

| | | | |
|---|---|---|---|
| JP | 1-131542 | | 9/1989 |
| JP | 2-117844 | | 5/1990 |
| JP | 2-121853 | | 5/1990 |
| JP | 3-216352 | | 9/1991 |
| JP | 4-319450 | | 11/1992 |
| JP | 6-262794 | | 9/1994 |
| JP | 6-328760 | | 11/1994 |
| JP | A-06-328760 | | 11/1994 |
| JP | 7-137328 | | 5/1995 |
| JP | 2001-010149 | | 1/2001 |
| JP | A-2001-268384 | | 9/2001 |
| JP | A-2001-270144 | | 10/2001 |
| JP | 2002303927 | * | 10/2002 |
| WO | WO 01/01669 A1 | | 1/2001 |

* cited by examiner

| TIME | 30℃ | | | 35℃ | | | 40℃ | | | ··· |
|---|---|---|---|---|---|---|---|---|---|---|
| | C | M | Y | C | M | Y | C | M | Y | |
| 1 | 0 | -2 | -1 | 1 | -5 | -3 | 1 | -5 | -3 | ··· |
| 2 | 0 | -3 | -1 | 1 | -5 | -3 | 1 | -5 | -3 | ··· |
| ⋮ | ⋮ | ⋮ | ⋮ | ⋮ | ⋮ | ⋮ | ⋮ | ⋮ | ⋮ | ··· |
| 9 | 1 | -7 | -4 | 2 | -6 | -3 | 2 | -9 | -4 | ··· |
| 10 | 1 | -7 | -4 | 2 | -7 | -4 | 2 | -9 | -4 | ··· |
| ⋮ | ⋮ | ⋮ | ⋮ | ⋮ | ⋮ | ⋮ | ⋮ | ⋮ | ⋮ | ··· |

FIG.4

PRINTING SYSTEM THAT CORRECTS IMAGE DATA BASED ON ENVIRONMENTAL HISTORY DATA

BACKGROUND OF THE INVENTION

1. Field of the Invention

The present invention relates to a printing system including a box and a printer, which is installed on a street. More particularly, it pertains to a printing system that can appropriately correct a color tone, based on history data relating to the temperature or humidity in the box.

2. Background Art

A printing system of a sublimation transfer recording type is known as a system that uses a sublimation dye to transfer a color material by a thermal head so as to form a full-color image. Such a printing system is utilized for various purposes, such as printing an image based on digital data of a picture taken by a camera.

The printing system can be installed on a street such that a user operates the same to print digital data. The printing system includes a media terminal box (so-called a kiosk terminal) and a printer of a sublimation transfer recording type disposed in the box.

The media terminal box has a touch panel monitor, slots for various recording media, an audio assist speaker, slots for coins and bills, a return coin lever, a change drop, a printed matter pick-up port, and so on. The box incorporates therein a central processing unit (CPU), a memory, an external storage unit for storing image data, a printer, and so on.

In order to print a photograph of a celebrity (so-called celebrity portrait) using this printing system, a "celebrity photo" is first selected from a menu displayed on the touch panel monitor.

After "celebrity photo" is selected, all or a part of the images of "celebrity photo" capable of being printed are displayed in a list. Then, an image desired to be printed is selected from the displayed list through the monitor.

Thereafter, the desired number of photos is specified through the monitor, and an "OK" instruction is entered in reply to a confirmation screen. Then, the desired image is printed.

An image is printed according to the following procedure. Image data corresponding to a specified image are read out from the external storage unit, and then the read-out image data are sent to the memory in the media terminal box.

The image data sent to the memory are sequentially read out, and then sent to the printer.

The printer stores the received image data in a memory of the printer. In the printer of a sublimation transfer recording type, for example, the image data are sequentially transferred by signals of a thermal head to an ink ribbon in which sublimation dye molecules are dispersed to thereby form a full-color image.

However, such a conventional printing system has the following disadvantages. That is, since an ink ribbon containing a sublimation dye and an image receiving sheet are left in the media terminal box for a long time, properties of the ink ribbon and the image receiving sheet may be changed because of changes in a dispersion state and an association state of the dye of the ink ribbon.

In particular, when the ink ribbon and the image receiving sheet are subject to high temperature and high humidity for a long time, properties thereof may be changed remarkably. When an image is printed by using such an ink ribbon and image receiving sheet, the printed image has such a color tone that is different from an original one.

In addition, since the media terminal box can be installed in various indoor and outdoor locations, it may be possible that the box is installed in a location where predetermined operating environments and conditions are not satisfied. Alternatively, even when the media terminal box itself is installed in a location where the predetermined operating environments and conditions are satisfied, the temperature and humidity around the ink ribbon and the receiving sheet may not satisfy the predetermined operating environments and conditions, depending on a structure of the box. In this case, a color tone of a printed image may change to deteriorate a printing quality thereof.

Further, since the media terminal box is installed under various environments, it is difficult for each box to maintain a constant temperature and humidity therein. A change of color tone caused by changes with time, temperature, and humidity varies for each media terminal, and therefore a uniform correction of the color tone is difficult.

SUMMARY OF THE INVENTION

The present invention is made in view of the above problems. An object of the present invention is to provide a printing system capable of appropriately printing an image, based on inherent properties of an ink ribbon and an image receiving sheet, taking changes in the temperature and the humidity over the time into consideration.

A printing system according to the present invention comprises: a box; a printer disposed in the box; storing means including image data, history data relating to at least one of temperature or humidity in the box, and correction data incorporating therein a relationship between the temperature or the humidity and a correction value for a color tone of the image data; and correcting means that reads the image data, the history data, and the correction data out of the storing means, corrects a color tone of the image data by means of the history data and the correction data to generate corrected image data, and sends the corrected image data to the printer.

In the printing system, the printer may include an ink ribbon containing a sublimation dye.

In the printing system, the printer may carry out multicolor printing by means of the ink ribbon containing a sublimation dye.

In the printing system, the storing means may include a plurality of image data incorporated therein, and the system may further comprise a display part having a function for selecting desired image data from the storing means.

In the printing system, the correction data of the storing means may have a relationship of at least one of the temperature or humidity, an elapsed time of the temperature or the humidity in the box, and the correction value for a color tone of the image data.

In the printing system, the correction value for a color tone of the image data may be a correction value for the respective colors of cyanogen, magenta, and yellow.

In the printing system, the correction value for a color tone of the image data may be changed in accordance with a gradation value of the image data.

In the printing system, the correcting means may generate the corrected image data by adding the correction value for a color tone to the image data.

In the printing system, the correcting means may generate the corrected image data by multiplying the image data by the correction value for a color tone as a coefficient.

In the printing system, the system further may comprises: measuring means that measures the temperature or humidity in the box, and sends the measured value to the storing means.

A printing system according to the present invention comprises: a box; a printer disposed in the box; storing means including image data, history data relating to at least one of the temperature or humidity in the box, and an International Color Consortium (ICC) profile relating to a temperature condition or a humidity condition; and correcting means that reads the image data, the history data, and the ICC profile out of the storing means, corrects a color tone of the image data by means of the history data and the ICC profile to generate a corrected image data, and sends the corrected image data to the printer.

BRIEF DESCRIPTION OF THE DRAWINGS

FIG. 4 is a chart showing an example of correction data according to the present invention.

DETAILED DESCRIPTION OF THE INVENTION

Figure 1:
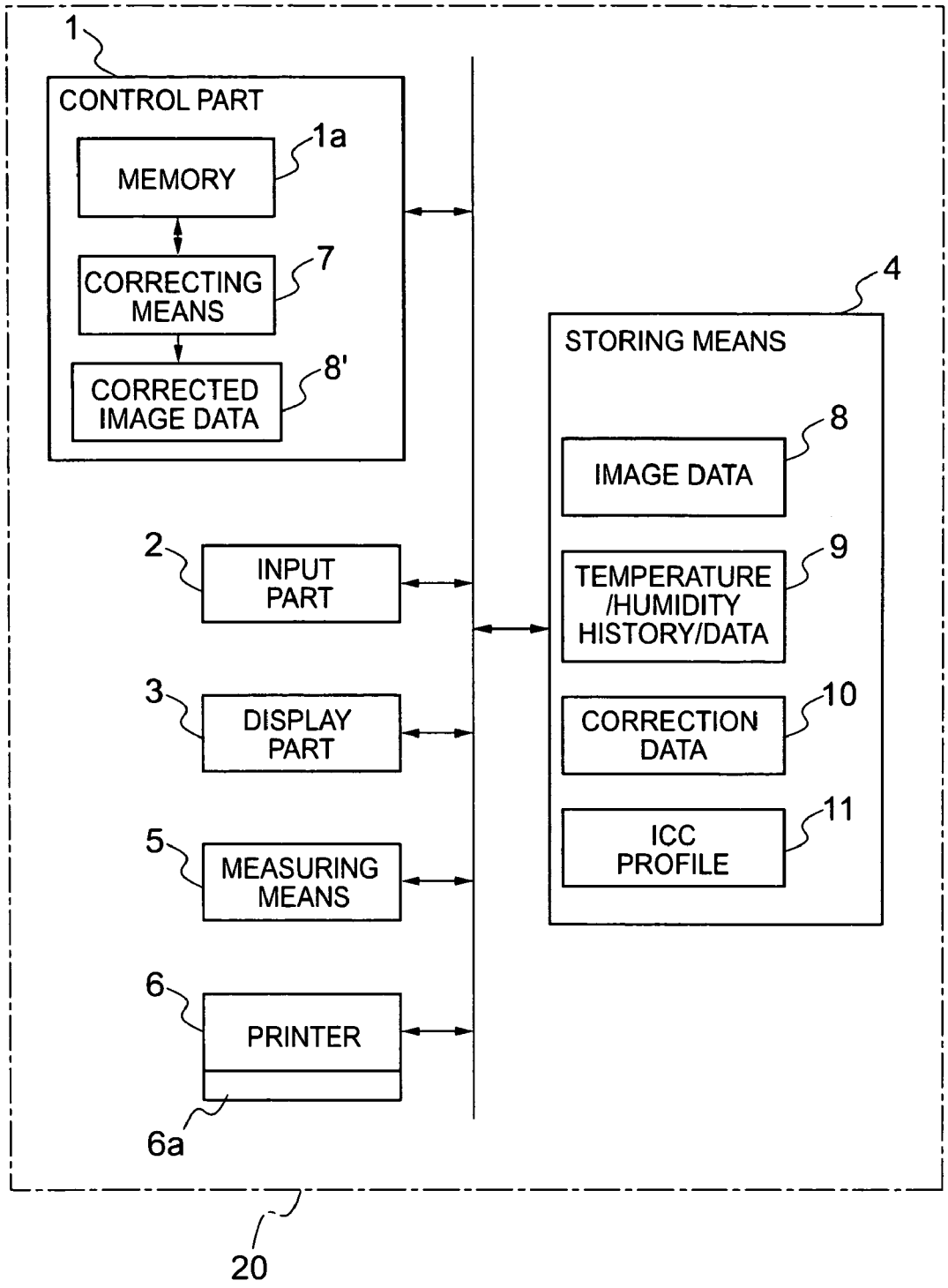
FIG. 1 is a block diagram showing a structure of a printing system according to the present invention.

A printing system according to the present invention is described hereinbelow with reference to the drawings.

In FIGS. 1 to 4, the printing system includes a media terminal box 20. In the box 20, there are disposed a control part 1, an input part 2, a display part 3, storing means 4, measuring means 5, and a printer 6.

The storing means 4 has a plurality of image data 8; history data 9 relating to the temperature and humidity in the box 20; correction data 10 incorporating therein a relationship of the temperature and the humidity, a correction value for a color tone of image data, and an elapsed time of the temperature and humidity; and an ICC profile 11 relating to a temperature condition and a humidity condition.

The control part 1 is a CPU, and has a memory 1*a* and correcting means 7. The correcting means 7 reads the desired image data 8, the temperature/humidity history data 9, and the correction data 10 from the storing means 4, and corrects a color tone of the image data 8 by means of the temperature/humidity history data 9 and the correction data 10 so as to generate corrected image data 8'.

The input part 2 has a reader to which various storage media that stores image data are inserted, or a scanner that scans images of printed matters as image data.

The display part 3 is a touch panel monitor on which an operation guidance, an operation condition, and an image to be printed can be displayed. A user can input an order, an indication for printing, and so on through the display part 3.

The storing means 4 is actually an external storage unit such as a hard disk. As described above, the storing means 4 has the image data 8, the history data 9 relating to the temperature and humidity in the box 20, the correction data 10 for a color tone based on the temperature and humidity, and the ICC profile 11 on the basis of which a color tone of the printer 6 is corrected.

The measuring means 5 is a temperature/humidity sensor disposed in the media terminal box 20. The measuring means 5 can measure temperature and humidity in the box 20 at certain prescribed intervals, and sends the measured values to the storing means 4. The temperature/humidity history data 9 is obtained by means of the measured values.

The printer 6 is of a sublimation transfer recording type, and has an ink ribbon containing a sublimation dye. The printer 6 stores the corrected image data 8' sent from the control part 1 in a memory 6*a* of the printer 6, and sequentially reads the corrected image data 8' from the memory 6*a* to print an image based on the corrected image data 8', whereby a full-color printing is carried out.

An operation of the embodiment as constituted above is described below with reference to FIG. 2.

Figure 2:
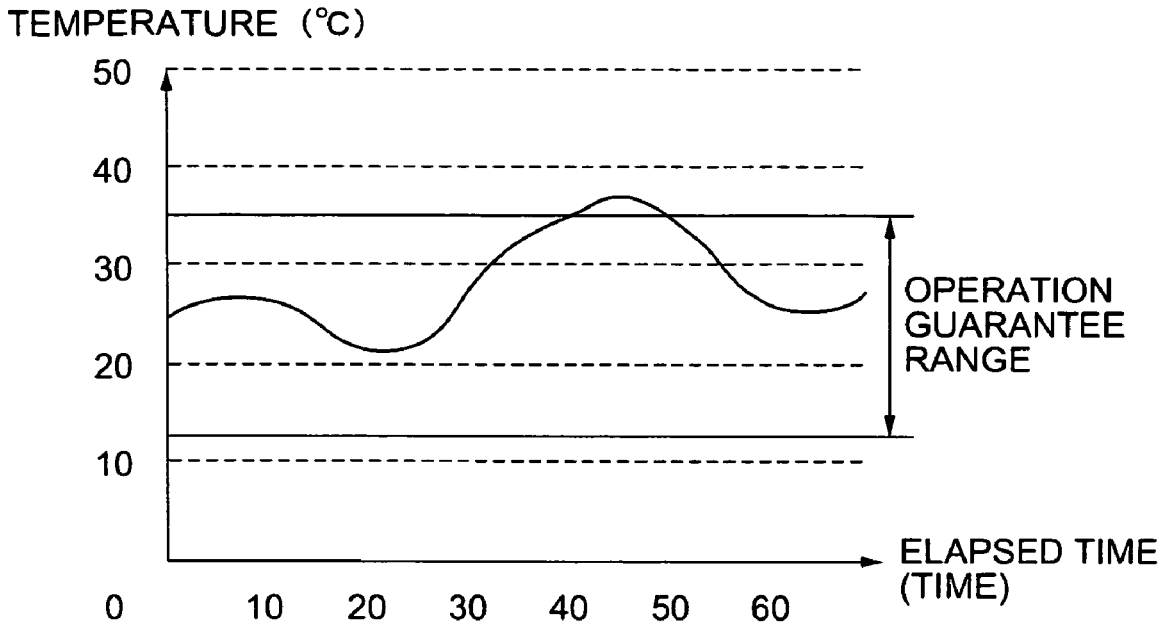
FIG. 2 is a graph showing an example of a temperature change recorded by measuring means.
Figure 3:
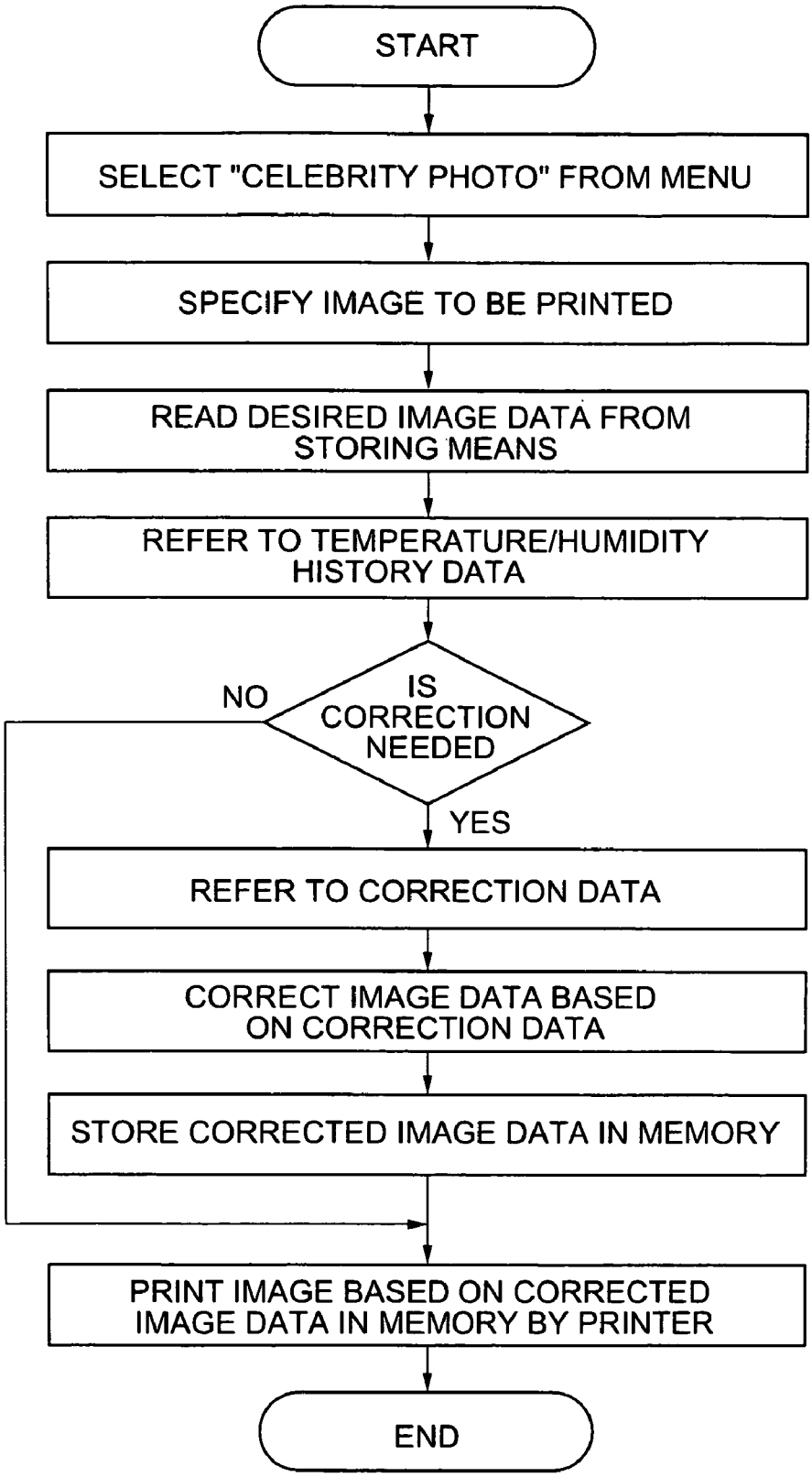
FIG. 3 is a flowchart showing an operation of the printing system according to the present invention.

FIG. 2 is a graph showing a change of the temperature measured in a predetermined period by the measuring means 5 disposed in the box 20.

As shown in FIG. 2, during 10 hours between elapsed times of 40 hours and 50 hours, the temperature in the box 20 surpasses, for some reason, a range where an operation and printing quality is guarantied. An operation of the system is guaranteed in a range of from 12° C. to 35° C.

A printing procedure of a "celebrity photo" is carried out, after the temperature in the box 20 is changed as described above. The printing procedure will be described below with reference to a flowchart shown in FIG. 3.

A "celebrity photo" is first selected from a menu displayed on the touch panel monitor as the display part 3.

After "celebrity photo" is selected, all or a part of the images of "celebrity photo" capable of being printed are displayed in a list. Then, an image desired to be printed is selected from the displayed list on the touch panel monitor 3 through a panel of the touch panel monitor 3.

Thereafter, the desired number of photos is specified through the touch panel monitor 3, and an "OK" instruction is entered in reply to a confirmation screen to instruct to print the desired image.

Then, the control part 1 reads the desired image data 8 from the storing means 4 corresponding to the image specified through the touch panel monitor 3. The read-out image data is stored in the memory 1*a* of the control part 1.

Then, referring to the correction data 10 shown in FIG. 4, the correcting means 7 corrects a color tone of the image data 8 stored in the memory 1*a* in accordance with the change of the temperature to thereby generate the corrected image data 8'. The corrected image data 8' is again stored in the memory 1*a*.

When an image is printed at the point of the elapsed time of 50 hours shown in FIG. 2, for example, the temperature/humidity history data 9 indicates that the image is printed after an inside of the box 20 has been left under an environment above 35° C. which is an upper limit of the operation guarantee range.

The correction data 10 in FIG. 4 shows correction values for respective colors of C (cyanogen), M (magenta), and Y (yellow). In the above case, the correcting means 7 adds the correction values of C=2, M=−7, and Y=−4, which are recorded in the cells corresponding to the temperature of 35° C. and the elapsed time of 10 hours, to a gradation value of the image data 8. The corrected image data 8' thus corrected is stored in the memory 1*a* by the correcting means 7.

The correction data 10 shown in FIG. 4 are created based on a combination of the temperature and elapsed time. However, the correction data 10 may be created based on a combination of a plurality of conditions. For example, it is possible to create the correction data 10 based on a combination of the humidity and elapsed time, or a combination of the temperature, humidity, and elapsed time.

Not limited to the patterns shown in FIG. 4, the correction value of the correction data 10 may be changed in accordance with the gradation value of the image data 8. Further, not limited to an addition of the correction value to the gradation value of the image data 8, a correction coefficient may be stored as the correction data 10 in FIG. 4, and the gradation value of the image data 8 may be multiplied by the correction coefficient (correction value).

In addition, the corrected image data 8' may be generated by correcting the image data 8 by means of the ICC profile 11 corresponding to the temperature condition stored in the storing means 4 and the temperature/humidity history data 9. The ICC profile 11 means a file in which features of a color reproduction of devices used in a color management system are stored.

The control part 1 sequentially reads the corrected image data 8' stored in the memory 1*a*, and sends the read-out data to the printer 6. Therefore, a full-color printing with a desired color tone can be carried out, which is in conformity with inherent features of an ink ribbon and an image receiving sheet.

The present invention has been described in detail based on the above embodiment. However, the printing system according to the present invention is not limited to the above embodiment, and various changes and modifications can be made without departing from the scope of the invention. Not limited to a printing system having an ink ribbon containing a sublimation dye, it goes without saying that the present invention can be applied to a printing system subject to the temperature and humidity, such as an optical fixing direct thermal recording type printing system, an ink jet recording type printing system, and so on.

As described above, in the printing system according to the present invention, the temperature and humidity in a box are measured and stored by measuring means, and a color tone can be corrected based on the stored temperature and humidity.

Accordingly, an appropriate printing quality can be constantly obtained by a media terminal box which may be located in various locations where operating conditions and environments thereof are changeable.

The invention claimed is:

1. A printing system, comprising:

a box;

a printer disposed in the box;

storing means for storing image data, history data, an International Color Consortium (ICC) profile relating to a temperature condition or a humidity condition, and correction data; and correcting means for reading the image data, the history data, and the correction data out of the storing means, correcting a color tone of the image data based on the history data and the International Color Consortium (ICC) profile relating to a temperature condition or a humidity condition generate corrected image data, and sending the corrected image data to the printer;

wherein:

the history data comprises temperature and humidity measurements of the environment within the box taken at predetermined intervals preceding a printing operation; and the correction data comprises information regarding a relationship between the temperature and humidity of the environment within the box and a correction value for the color tone of the image data.

2. The printing system according to claim 1, wherein the printer includes an ink ribbon containing a sublimation dye.

3. The printing system according to claim 2, wherein the printer carries out multi-color printing by means of the ink ribbon containing a sublimation dye.

4. The printing system according to claim 1, wherein the storing means includes a plurality of image data incorporated therein, and the system further comprises a display part having a function for selecting desired image data from the storing means.

5. The printing system according to claim 1, wherein the correction data of the storing means has a relationship of at least one of the temperature or humidity, an elapsed time of the temperature or humidity in the box, and the correction value for a color tone of the image data.

6. The printing system according to claim 5, wherein the correction value for a color tone of the image data is a correction value for the respective colors of cyanogen, magenta, and yellow.

7. The printing system according to claim 5, wherein the correction value for a color tone of the image data is changed in accordance with a gradation value of the image data.

8. The printing system according to claim 1, wherein the correcting means generates the corrected image data by adding the correction value for a color tone to the image data.

9. The printing system according to claim 1, wherein the correcting means generates the corrected image data by multiplying the image data by the correction value for a color tone as a coefficient.

10. The printing system according to claim 1 further comprising:

measuring means that measures the temperature or humidity in the box, and sends the measured value to the storing means.

11. A printing system comprising:

a box;

a printer disposed in the box;

storing means for storing image data, history data, and an International Color Consortium (ICC) profile relating to a temperature condition or a humidity condition; and correcting means for reading the image data, the history data, and the ICC profile out of the storing means, correcting a color tone of the image data based on the history data and the ICC profile to generate corrected image data, and sending the corrected image data to the printer;

wherein the history data comprises temperature and humidity measurements of the environment within the box taken at predetermined intervals preceding a printing operation.

* * * * *